US008771043B2

(12) United States Patent
Sakakibara et al.

(10) Patent No.: US 8,771,043 B2
(45) Date of Patent: Jul. 8, 2014

(54) ROTARY DRESSER

(75) Inventors: Sadao Sakakibara, Hekinan (JP); Shinji Soma, Handa (JP)

(73) Assignees: Toyoda Van Moppes Ltd., Okazaki-shi (JP); JTEKT Corporation, Osaka-shi (JP)

( * ) Notice: Subject to any disclaimer, the term of this patent is extended or adjusted under 35 U.S.C. 154(b) by 314 days.

(21) Appl. No.: 13/171,744

(22) Filed: Jun. 29, 2011

(65) Prior Publication Data

US 2012/0108153 A1 May 3, 2012

(30) Foreign Application Priority Data

Oct. 27, 2010 (JP) ..... 2010-241412

(51) Int. Cl.
*B24B 53/12* (2006.01)

(52) U.S. Cl.
USPC ..... 451/443; 451/444; 125/11.03

(58) Field of Classification Search
USPC ..... 451/443, 444; 125/11.03, 2, 3, 39, 5
See application file for complete search history.

(56) References Cited

U.S. PATENT DOCUMENTS

| | | | | | |
|---|---|---|---|---|---|
| 2,014,955 | A * | 9/1935 | Taylor | 76/108.2 |
| 2,443,370 | A * | 6/1948 | Bakker | 125/39 |
| 2,827,037 | A * | 3/1958 | Wallace et al. | 125/11.03 |
| 3,347,219 | A * | 10/1967 | Wellborn | 125/11.03 |
| 3,398,989 | A * | 8/1968 | Christensen | 299/39.4 |
| 3,602,209 | A * | 8/1971 | Bocker | 125/11.03 |
| 3,626,435 | A * | 12/1971 | Tuczak | 451/544 |
| 4,175,537 | A * | 11/1979 | Wiener | 125/11.03 |
| 4,805,586 | A * | 2/1989 | Borse | 125/11.01 |
| 5,020,282 | A * | 6/1991 | Okajima et al. | 451/541 |
| 5,496,208 | A * | 3/1996 | Neff | 451/541 |
| 5,769,700 | A * | 6/1998 | Holden et al. | 451/541 |
| 6,361,412 | B1 * | 3/2002 | Kaiser | 451/56 |
| 6,561,879 | B2 * | 5/2003 | Voigt | 451/56 |
| 7,153,201 | B2 * | 12/2006 | Smith | 451/540 |
| 2002/0068518 | A1 * | 6/2002 | Cesena et al. | 451/541 |
| 2006/0286911 | A1 * | 12/2006 | Smarsh | 451/443 |

FOREIGN PATENT DOCUMENTS

| | | |
|---|---|---|
| JP | 2009-285776 | 12/2009 |
| WO | WO92/19422 A1 | 11/1992 |

OTHER PUBLICATIONS

European Search Report issued Mar. 25, 2014 in European Patent Application No. 11172487.8-1702/2447005.

* cited by examiner

*Primary Examiner* — Lee D Wilson
*Assistant Examiner* — Tyrone V Hall, Jr.
(74) *Attorney, Agent, or Firm* — Oblon, Spivak, McClelland, Maier & Neustadt, L.L.P.

(57) ABSTRACT

A rotary dresser is provided with a roll having an outer circumferential surface which includes an arc portion or inclined portion differing in diameter in dependence on the axial position thereof, and a plurality of diamond abrasive grains embedded on the outer circumferential surface of the roll. The number of the diamond abrasive grains in the circumferential direction is fixed even at any axial position on the outer circumferential surface of the roll.

9 Claims, 4 Drawing Sheets

ROTARY DRESSER

This application is based on and claims priority under 35 U.S.C 119 with respect to Japanese patent application No. 2010-241412 filed on Oct. 27, 2010, the entire content of which is incorporated herein by reference.

BACKGROUND OF THE INVENTION

1. Field of the Invention

The present invention relates to a rotary dresser having diamond abrasive grains arranged on an outer circumference of a roll.

2. Discussion of the Related Art

Rotary dressers with a plurality of the diamond abrasive grains embedded on an outer circumferential surface of a rotatable roll are well-known as described in, e.g., JP 2009-285776 A. In the rotary dressers of this kind, diamond abrasive grains are usually arranged spirally at a predetermined interval on an outer circumferential surface of a roll, so that the distribution density of the diamond abrasive grains per area is made to be fixed.

As shown in FIG. 7, in a rotary dresser having a roll 4 with cylinder portions 1, 2 at both axial end portions and with a concave arc portion 3 between the cylinder portions 1, 2, the distribution density of diamond abrasive grains 5 is set to be fixed at the arc portion 3. Thus, the number of the diamond abrasive grains 5 which are arranged on the concave arc portion 3 in the circumferential direction differs in dependence on the circumferential length at each of axial positions of the concave arc portion 3. That is, as shown by the graph in the same figure, the number of the diamond abrasive grains 5 in the circumferential direction (i.e., the quantity of diamond in the circumferential direction) becomes smaller at a small-diameter portion of the arc portion 3, while the number of the diamond abrasive grains 5 in the circumferential direction becomes larger as the axial position comes close to each of both end portions on the arc portion 3.

As a result, the number of the diamond abrasive grains which act on a grinding wheel per rotation of the dresser is increased at a portion that has a large number of the diamond abrasive grains in the circumferential direction. This results in increasing the dressing resistance at that portion and hence, in causing grinding burns to be liable to be generated on the grinding wheel. On the other hand, the number of the diamond abrasive grains which act on the grinding wheel per rotation of the dresser is decreased at another portion that has a small number of the diamond abrasive grains in the circumferential direction. Thus, the diamond abrasive grains at such another portion become larger in wear than those at the portion having the large number of diamond abrasive grains, and this gives rise to a problem that local wear or abrasion are liable to occur.

SUMMARY OF THE INVENTION

Accordingly, it is an object of the present invention is to provide a rotary dresser capable of maintaining the shape accuracy thereof over a long term as a result of decreasing the dressing resistance and suppressing local wear by equalizing the numbers of diamond abrasive grains in the circumferential direction at any axial positions.

Briefly, according to the present invention, there is provided an improved rotary dresser comprising a roll having an outer circumferential surface which includes an arc portion or inclined portion differing in diameter in dependence on an axial position thereof, and a plurality of diamond abrasive grains embedded on the outer circumferential surface of the roll. The number of the diamond abrasive grains in a circumferential direction is fixed even at any axial position on the outer circumferential surface of the roll.

With this construction, the rotary dresser is provided with the roll having the outer circumferential surface which includes the arc portion or inclined portion differing in diameter in dependence on the axial position thereof, and the plurality of diamond abrasive grains embedded on the outer circumferential surface of the roll, and the number of the diamond abrasive grains in the circumferential direction is fixed even at any axial position on the outer circumferential surface of the roll. Therefore, the number of the diamond abrasive grains which act on a grinding wheel per rotation of the dresser is maintained unchanged even at any axial position. As a result, the resistance during dressing can be reduced, and the local wear of the diamond abrasive grains can be suppressed, so that the shape accuracy which is liable to change can be maintained accurate over a long term.

BRIEF DESCRIPTION OF THE ACCOMPANY DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which.

Figure 6A:
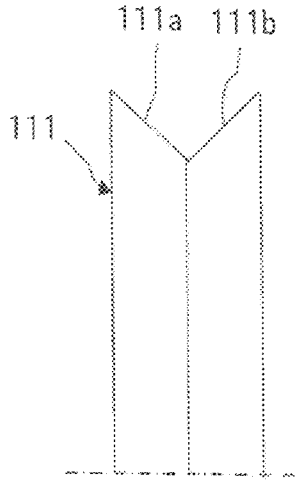
Figure 6B:
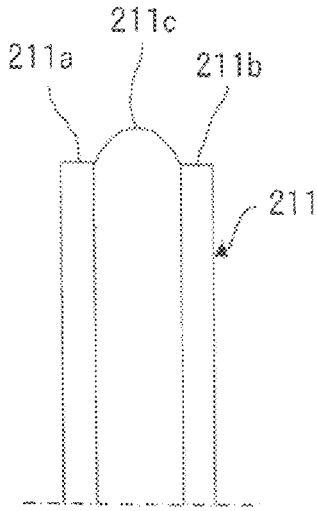
Figure 7:
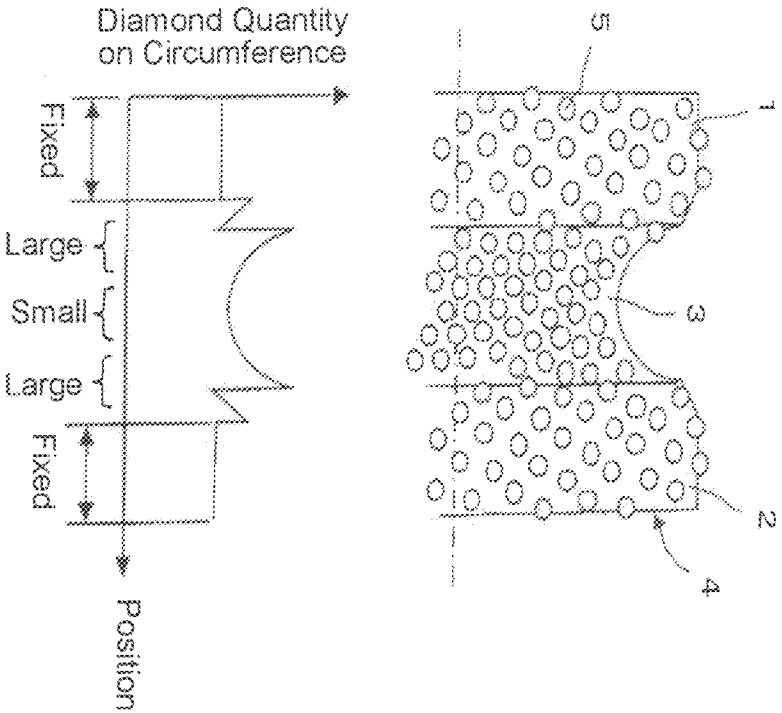
FIG. 7 PRIOR ART

FIGS. 6(A) and 6(B) are schematic views respectively showing modifications in the present invention; and FIG. 7 is a view showing the arranging state of diamond abrasive grains in the prior art.

DETAILED DESCRIPTION OF THE PREFERRED EMBODIMENTS

Figure 1:
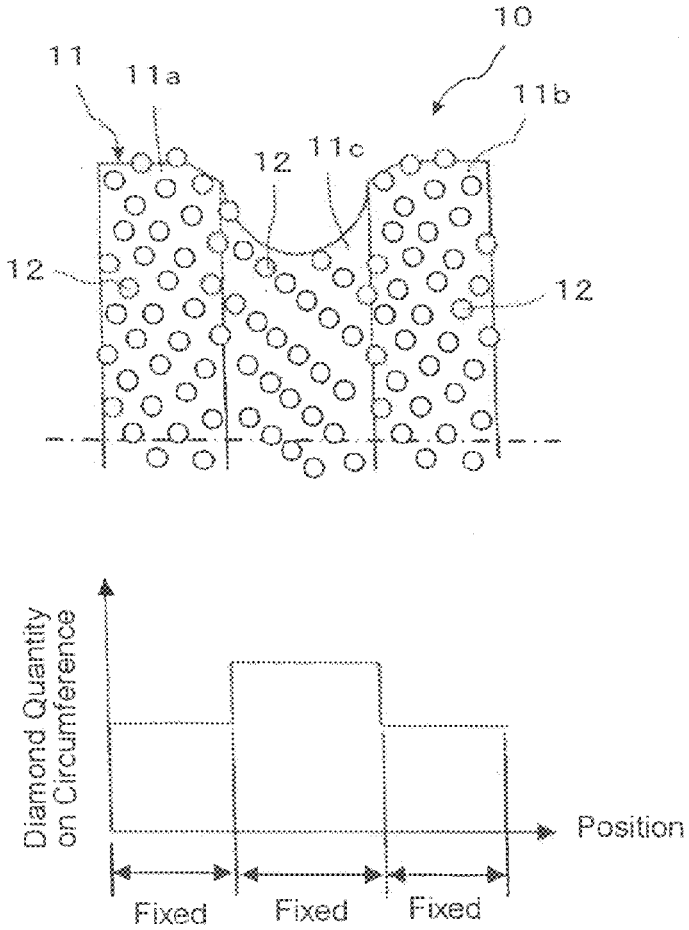
FIG. 1 is a front view of a rotary dresser in a first embodiment according to the present invention, wherein a graph is provided to show the quantities of diamond at respective portions on the rotary dresser.

Hereinafter, embodiments of the present invention will be described with reference to the drawings. FIG. 1 shows a rotary dresser 10. The rotary dresser 10 is composed of a rotatable roll 11 and a plurality of diamond abrasive grains 12 embedded on an outer circumferential surface of the roll 11. Basically, the diamond abrasive grains 12 are spirally arranged on the outer circumferential surface of the roll 11.

The roll 11 is provided with cylindrical cylinder portions 11*a*, 11*b* at both end portions in the axial direction thereof and is also provided with a concave semicircular arc portion 11*c* between these cylinder portions 11*a* and 11*b*. Both ends of the concave arc portion 11*c* in the axial direction are connected to edges of the cylinder portions 11*a* and 11*b*. The concave arc portion 11*c* is the largest in diameter at the both axial end portions and is the smallest in diameter at the axial center portion.

On the cylinder portions 11*a*, 11*b* of the roll 11, diamond abrasive grains 12 are arranged in almost even distribution density so that a fixed number (N1 pieces) of the diamond abrasive grains 12 exist in the circumferential direction even at any position in the axial direction. On the concave arc portion 11*c* of the roll 11, on the other hand, diamond abrasive grains 12 are arranged so that another fixed number (N2 pieces) of the diamond abrasive grains 12 exist in the circumferential direction even at any position (in any area) in the axial direction. That is, the distribution density of the diamond abrasive grains 12 at the concave arc portion 11*c* is made to differ in dependence on the diameters (i.e., circumferential lengths) at respective axial positions on the concave arc portion 11*c*. In other words, the larger the diameter of the concave arc portion 11*c* becomes, the lower the distribution density of the diamond abrasive grains 12 becomes. Consequently, irrespective of the difference in diameter at respective axial positions on the concave arc portion 11*c*, the fixed number (N2 pieces) of the diamond abrasive grains 12 are arranged in the circumferential direction even at any position (in any area) in the axial direction of the concave arc portion 11*c*.

In the embodiment, as shown by the graph in FIG. 1, the number N2 of the diamond abrasive grains 12 on any circumference (the quantity of diamond on any circumference) of the concave arc portion 11*c* is made to be larger than the number N1 of the diamond abrasive grains 12 on any circumference of each of the cylinder portions 11*a*, 11*b* (N2>N1). Thus, it is possible to precisely dress an arc portion of a grinding wheel which is to be dressed by the concave arc portion 11*c*. However, the concave arc portion 11*c* and each of the cylinder portions 11*a*, 11*b* may be equal in the number of the diamond abrasive grains 12 on any circumference thereof.

Next, with reference to FIGS. 2 and 3, description will be made regarding a method of arranging a fixed number of diamond abrasive grains 12 regularly on the circumference of the concave arc portion 11*c* of the roll 11.

Figure 2:
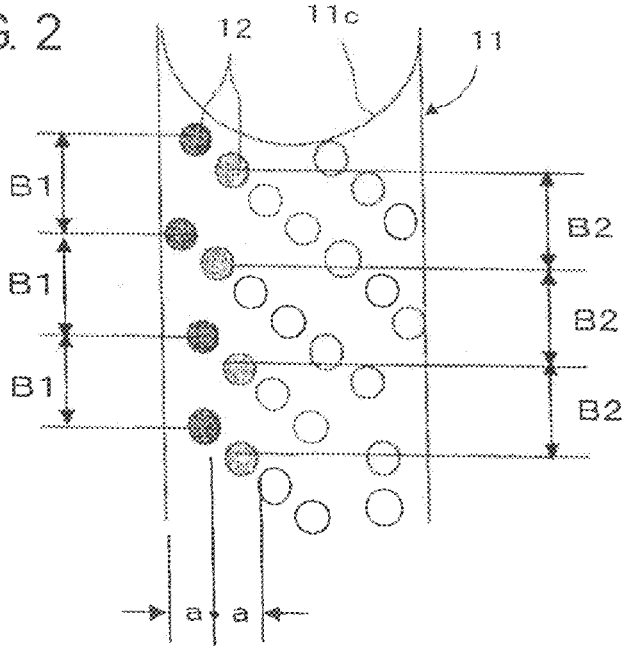
FIG. 2 is an explanatory view for explaining the arrangement of diamond abrasive grains at a concave arc portion of the roll.

In FIG. 2, the roll 11 is divided into a plurality of short widths (a) in the axial direction, and within each of the short widths (a), the diamond abrasive grains 12 are arranged in a zigzag fashion so that they are at a fixed interval (B1, B2, . . . or B5) in the circumferential direction and differ in the axial position. In this case, the circumferential length of the roll 11 continuously changes in dependence on the axial position, and therefore, as also shown in FIG. 3, the closer the axial position of the roll 11 comes to the center position, the narrower the interval of the diamond abrasive grains 12 in the circumferential direction is made to become (B1>B2> . . . >B5).

Figure 3:
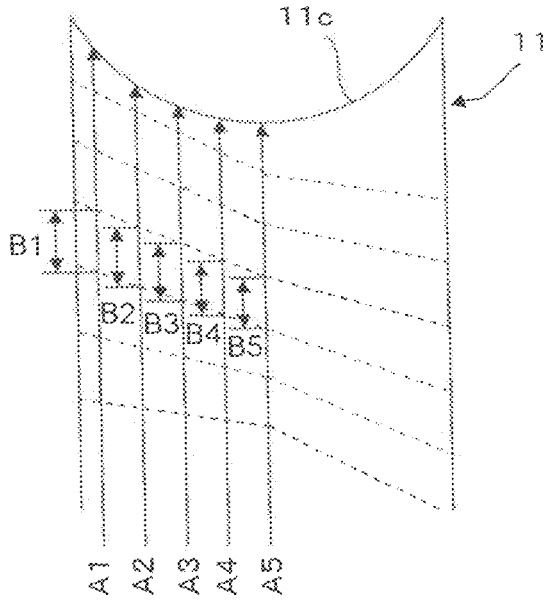
FIG. 3 is another explanatory view for explaining the arrangement of diamond abrasive grains at the concave arc portion of the roll.

That is, as shown in FIG. 3, on the assumption that circumference lengths at respective axial positions of the roll 11 spaced at the interval of the short width (a) are A1~A5, intervals B1~B5 in the circumferential direction of the diamond abrasive grains 12 within the respective shorts widths (a) are changed in proportion to the respective circumferential lengths A1~A5 on the roll 11, and the diamond abrasive grains 12 of the predetermined or fixed number are arranged at an equiangular interval within each short width (a).

Specifically, in the case of the roll 11 having the concave semicircular arc portion 11*c* as is the case of the present embodiment, and where the number of the diamond abrasive grains 12 to be arranged in the circumferential direction within each of the respective short widths (a) is set to M, the interval B1 of the diamond abrasive grains 12 in the circumferential direction along the circumferential length A1 is B1=A1/M, and likewise, the interval B5 of the diamond abrasive grains 12 in the circumferential direction along the circumferential length A5 is B5=A5/M. Consequently, it is possible to constitute the rotary dresser 10 which at the both end positions of the concave arc portion 11*c* in the axial direction, has the largest interval B1 of the diamond abrasive grains 12 in the circumferential direction and which at the center position of the concave arc portion 11*c* in the axial direction, has the smallest interval B5 of the diamond abrasive grains 12 in the circumferential direction.

Broken lines in FIG. 3 indicate imaginary lines for arrangements of the diamond abrasive grains 12 which are to be spirally arranged on the concave arc portion 11*c* of the roll 11.

Figure 4:
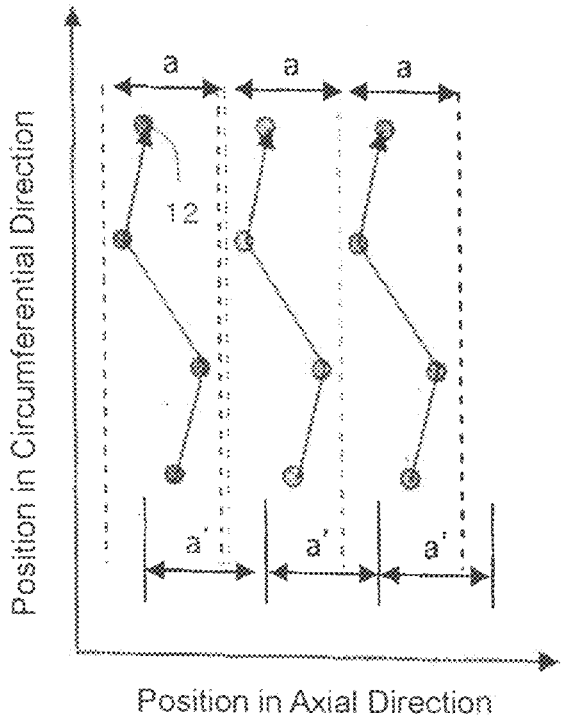
FIG. 4 is an explanatory view for explaining the arranging state of the diamond abrasive grains in the circumferential direction at respective axial positions of the roll.

In this way, by arranging the diamond abrasive grains 12 on the outer circumferential surface of the roll 11 under the aforementioned rules, even if the respective short widths (a) are slightly shifted in the axial direction to respective small widths (a') as shown in FIG. 4, it is possible to make the number of the diamond abrasive grains 12 in the circumferential direction fixed within each of the respective small widths (a').

In this case, the both end cylinder portions 11*a*, 11*b* do not change (i.e., is fixed) in diameter over the entire lengths thereof in the axial direction. Thus, by arranging the diamond abrasive grains 12 at a uniform density as is the case of the prior art, it is possible to make the number of the diamond abrasive grains in the circumferential direction fixed even at any axial position.

Figure 5:
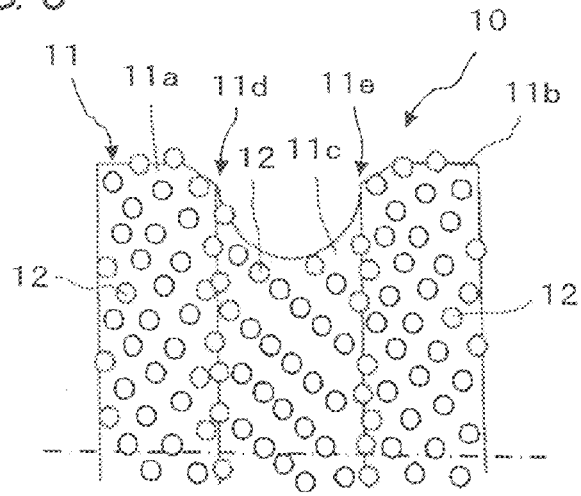
FIG. 5 is a front view of a rotary dresser in a second embodiment according to the present invention, wherein a graph is provided to show the quantities of diamond at respective portions on the rotary dresser.
Figure 5:
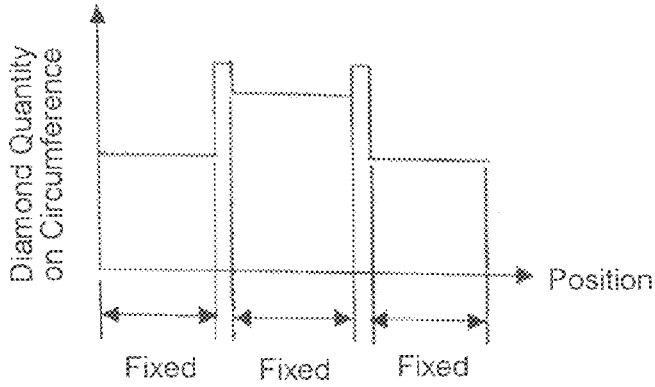

FIG. 5 shows a rotary dresser 10 in a second embodiment, wherein the differences from the first embodiment reside in that the number of the diamond abrasive grains 12 in the circumference direction at each of boundary portions 11*d*, 11*e* (corner portions of the concave arc portion 11*c*) between the cylinder portions 11*a*, 11*b* and the concave arc portion 11*c* of the roll 11 is increased (by, e.g., 60 pieces) than that of the diamond abrasive grains 12 in the circumferential direction at any axial position on the concave arc portion 11*c*.

According to the second embodiment, the number of the diamond abrasive grains 12 is increased in the circumference direction at each of boundary portions 11*d*, 11*e* between the cylinder portions 11*a*, 11*b* and the concave arc portion 11*c* of the roll 11. Therefore, the shape accuracy at the boundary portions 11*d*, 11*e* which are liable to change can be maintained over a long term.

According to the embodiments, the number of the diamond abrasive grains 12 is fixed in the circumferential direction at any axial position on the concave arc portion 11*c*. Thus, in dressing a grinding wheel with the rotary dresser 10, it is possible to make the number of the diamond abrasive grains 12 acting on the grinding wheel even at any axial direction. As a result, the resistance during dressing can be reduced, and the local wear of the diamond abrasive grains 12 can be suppressed, so that it is possible to maintain the shape accuracy of the rotary dresser 10 accurate over a long term.

Although in the foregoing embodiments, description has been made regarding the rotary dresser 10 which has the cylinder portions 11*a*, 11*b* at the both end portions in axial direction and the concave arc portion 11*c* between the cylinder portions 11*a*, 11*b*, the present invention is not limited to the rotary dresser of such shape. For instance, as shown in FIGS. 6(A) and 6(B), the present invention is also applicable to arranging diamond abrasive grains on the outer circumferential surface of a roll 111 provided with inclined portions 111*a*, 111*b* or another roll 211 provided with cylinder portions 211*a*, 211*b* and a convex arc portion 211*c*. That is, the present invention is applicable to rotary dressers of various kinds which use a roll with a cylindrical portion being not uniform in diameter.

APPLICABILITY IN THE INDUSTRIAL FIELD

The rotary dresser according to the present invention is suitable for application to those in which diamond abrasive grains are arranged on the outer circumference of a roll having an outer circumferential surface whose diameter differs in dependence on the axial direction.

Various features and many of the attendant advantages in the foregoing embodiments will be summarized as follows.

In each of the first and second embodiments and the modifications thereof typically shown in FIGS. 1, 5, 6(A) and 6(B), the rotary dresser 10 is provided with the roll 11 having the outer circumferential surface which includes the arc portion 11*c*, 211*c* or inclined portion 11*a*, 11*b* differing in diameter in dependence on the axial position thereof, and the plurality of diamond abrasive grains 12 embedded on the outer circumferential surface of the roll 11, and the number of the diamond abrasive grains 12 in the circumferential direction is fixed even at any axial position on the outer circumferential surface of the roll 11. Therefore, the number of the diamond abrasive grains 12 which act on a grinding wheel per rotation of the dresser 10 is maintained unchanged at any axial positions. As a result, the resistance during dressing can be reduced, and the local wear of the diamond abrasive grains 12 can be suppressed, so that the shape accuracy liable to change can be maintained accurate over a long term.

In each of the first and second embodiments typically shown in FIGS. 1 and 5, the outer circumferential surface of the roll 11 is composed of the cylinder portions 11*a*, 11*b* at both axial end positions and the concave arc portion 11*c* between the cylinder positions 11*a*, 11*b*. Thus, it is possible to obtain the rotary dresser 10 wherein each of the cylinder portions 11*a*, 11*b* has the diamond abrasive grains 12 arranged in even distribution density, while the concave arc portion 11*c* has the diamond abrasive grains 12 of the fixed number arranged in the circumference direction at any axial positions thereof.

In the second embodiment typically shown in FIG. 5, the number of the diamond abrasive grains 12 in the circumferential direction at the boundary portion 11*d*, 11*e* between each of the cylinder portions 11*a*, 11*b* and the concave arc portion 11*c* is increased than that of the diamond abrasive grains 12 in the circumferential direction at any axial position on the concave arc portion 11*c*. Therefore, the shape accuracy at the boundary portions 11*d*, 11*e* liable to change can be maintained accurate over a long term.

Obviously, numerous further modifications and variations of the present invention are possible in light of the above teachings. It is therefore to be understood that within the scope of the appended claims, the present invention may be practiced otherwise than as specifically described herein.

What is claimed is:

1. A rotary dresser comprising:

a roll having an outer circumferential surface including a first portion that varies in diameter relative to an axial position along a longitudinal axis of the roll and provides an arc portion or inclined portion of the outer circumferential surface;

a plurality of diamond abrasive grains embedded on the first portion of the outer circumferential surface of the roll, wherein a number of diamond abrasive grains in a circumferential direction for each of a plurality of equal widths of the first portion is a first number that is constant for the plurality of equal widths, wherein the plurality of equal widths of the first portion extend along the longitudinal axis of the roll from a first end of the first portion to a second end of the first portion, wherein for each of the plurality of equal widths, an interval in the circumferential direction between respective diamond abrasive grains is fixed, and wherein the interval varies based on an axial position along the longitudinal axis of a respective equal width.

2. The rotary dresser as set forth in claim 1, wherein the outer circumferential surface of the roll includes cylinder portions at axial end positions of the roll, and wherein the first portion is a concave arc portion arranged between the cylinder portions along the longitudinal axis of the roll.

3. The rotary dresser as set forth in claim 2, wherein a respective number of diamond abrasive grains in the circumferential direction for each boundary portion between each of the cylinder portions and the first portion is greater than the first number.

4. The rotary dresser as set forth in claim 1, wherein respective diamond abrasive grains in each of the plurality of equal widths of the first portion are arranged circumferentially in a zigzag fashion.

5. The rotary dresser as set forth in claim 1, wherein the diamond abrasive grains are arranged spirally on the outer circumferential surface of the roll.

6. The rotary dresser as set forth in claim 1, wherein the outer circumferential surface of the roll includes second portions, wherein the first portion is arranged between the second portions along the longitudinal axis of the roll, wherein a number of diamond abrasive grains in the circumferential direction for each of the second portions is a second number and is constant for the second portions, wherein the first number is not equal to the second number.

7. The rotary dresser as set forth in claim 6, wherein each of the second portions is a cylinder portion having a constant diameter, and wherein the second number is less than the first number.

8. The rotary dresser as set forth in claim 6, wherein the outer circumferential surface of the roll includes third portions, wherein the first portion and the second portions are arranged between the third portions along the longitudinal axis of the roll, wherein each of the third portions is a cylinder portion having a constant diameter, wherein a number of diamond abrasive grains in the circumferential direction for each of the third portions is a third number and is constant for the third portions, and wherein the second number is greater than the first number, and the first number is greater than the third number.

9. The rotary dresser as set forth in claim 1, wherein a respective interval of an equal width at the first end of the first portion is greater than a respective interval of an equal width at a center of the first portion and is equal to a respective interval of an equal width at the second end of the first portion.

* * * * *